US009015995B2

(12) United States Patent
Bowser

(10) Patent No.: US 9,015,995 B2
(45) Date of Patent: Apr. 28, 2015

(54) SECURITY SHUTTER ASSEMBLY

(76) Inventor: Chad Bowser, Upland, CA (US)

( * ) Notice: Subject to any disclaimer, the term of this patent is extended or adjusted under 35 U.S.C. 154(b) by 0 days.

(21) Appl. No.: 13/309,013

(22) Filed: Dec. 1, 2011

(65) Prior Publication Data

US 2013/0139442 A1 Jun. 6, 2013

(51) Int. Cl.

| | |
|---|---|
| ***E06B 7/08*** | (2006.01) |
| ***E05B 65/06*** | (2006.01) |
| ***E06B 7/084*** | (2006.01) |

(52) U.S. Cl.

CPC ..... *E05B 65/06* (2013.01); *E06B 7/084* (2013.01)

(58) Field of Classification Search

USPC ..... 49/74.1, 77.1, 64, 87.1, 79.1, 80.1, 142, 49/163, 168, 169, 171, 161, 394, 395

See application file for complete search history.

(56) References Cited

U.S. PATENT DOCUMENTS

| | | | | |
|---|---|---|---|---|
| 163,679 | A * | 5/1875 | Merrill | 49/87.1 |
| 1,798,540 | A * | 3/1931 | Kelly | 49/168 |
| 2,611,933 | A * | 9/1952 | Comfort | 52/207 |
| 3,333,878 | A * | 8/1967 | Pelcin | 292/37 |
| 4,323,104 | A * | 4/1982 | Guttman | 160/92 |
| 4,709,506 | A * | 12/1987 | Lukaszonas | 49/87.1 |
| 5,579,605 | A * | 12/1996 | Tanaka | 49/171 |
| 5,802,765 | A * | 9/1998 | Vickery | 49/67 |
| 6,715,527 | B2 * | 4/2004 | Ardoin | 160/104 |
| 6,923,028 | B2 * | 8/2005 | Caldwell et al. | 70/56 |
| 7,793,463 | B1 * | 9/2010 | Stansberry et al. | 49/395 |
| 2007/0089369 | A1 * | 4/2007 | Gore et al. | 49/67 |

* cited by examiner

*Primary Examiner* — Katherine Mitchell
*Assistant Examiner* — Shiref Mekhaeil
(74) *Attorney, Agent, or Firm* — Patent Venture Group; Joe A. Brock, II

(57) ABSTRACT

An invention is provided for a security shutter assembly. The security shutter assembly includes a shutter door having a plurality of operable louvers pivotally mounted between vertical stiles. A locking element is attached to the first vertical stile, and can be set in a locked position that secures the shutter door closed, and an open position that allows the shutter door to be opened. The locking element includes a louver flange portion that extends over the louvers when the louvers are in the closed position and the locking element is in the open position. However, the louvers block the louver flange from being positioned over the louvers when the louvers are in the open position, thus preventing the locking element from being placed in the open, and unlocked, position while the louvers are in the open position.

15 Claims, 11 Drawing Sheets

SECURITY SHUTTER ASSEMBLY

BACKGROUND OF THE INVENTION

1. Field of the Invention

This invention relates generally to shutter assemblies, and more particularly to a security shutter assembly having added protection from unwanted opening.

2. Description of the Related Art

In the interest of security, fixed bars and grating have been used to protect against unwanted entry via windows and other exterior apertures of structures. Such exterior bars can be routinely seen adorning the windows of homes and businesses in high crime areas. Moreover, as crime has moved into prosperous areas, such exterior bars can be seen in more affluent areas formally believed to be secure.

Such bars and grates often take the form of fixed locking bars or grating on the exterior of windows. These security measures are useful in that they allow light to enter the window that the device is securing. They also allow individuals inside the adjoining room to see outside the protected window. However bars and grates can be dangerously restrictive in the event of an emergency, where fast egress is needed, such as in the event of a fire. Another typical form of security is a roll-up barrier that functions similar to a paneled garage door. This form of security is even more restrictive than the above-mentioned bars in grates in that the roll-up barrier generally does not allow the entry of light nor does it allow vision outside the secured window. In addition, the roll-up barrier suffers from the same dangerously restrictive deficiency as set forth above with respect to the bars and grates.

A further disadvantage of the prior art security devices discussed above, is that they are all generally considered unattractive. For example, homes having locked security bars installed on the windows can in fact dissuade potential home buyers from purchasing the home because of both the unattractiveness of such devices and a perceived apprehension of the neighborhood brought on by the sight of such securities measures. Buyers can further be discouraged by an apprehension of what may occur in the event of an emergency where no escape can be made from the protected windows.

In view of the foregoing, there is a need for an apparatus for providing security while remaining esthetically pleasing. The apparatus should allow for essentially normal use of the secured aperture, while preventing unwanted entry. Moreover, the apparatus should allow for easy egress in the event of an emergency, while still maintaining a secure aperture.

SUMMARY OF THE INVENTION

Broadly speaking, the present invention addresses these needs by providing a security shutter assembly that looks and operates in a similar manner to standard shutters. The security shutter assembly provides security by being formed of a strong material, such as steel or other metal. Yet, the security shutter assembly provides the appearance of standard shutters, such as standard plantation shutters. Moreover, embodiments of the present invention allow the shutter to be easily opened from the inside to allow easy egress, yet maintains security by preventing opening of the shutter from outside the aperture or structure on which it is mounted.

In one embodiment, the security shutter assembly includes a shutter door having first and second vertical stiles, wherein a plurality of operable louvers is pivotally mounted between the vertical stiles. The plurality of operable louvers can be rotated to an open position and a closed position, generally using a tilt rod. In addition, a locking element is included. The locking element is attached to the first vertical stile, and can be set in a locked position that secures the shutter door closed and an open position that allows the shutter door to be opened. However, the locking element cannot be positioned in the open position when the plurality of louvers also is positioned in the open position. This is because the locking element includes a louver flange portion that extends over the louvers when the louvers are in the closed position and the locking element is in the open position. However, the louvers block the louver flange from being positioned over the louvers when the louvers are in the open position, thus preventing the locking element from being placed in the open position while the louvers are in the open position.

A further security shutter assembly is disclosed in a further embodiment of the present invention. Here, the security shutter assembly includes an inner frame assembly and a shutter door disposed within the inner frame assembly. As above, the shutter door includes a first and second vertical stiles and a plurality of operable louvers pivotally mounted between the vertical stiles. The plurality of operable louvers can be rotated to an open position and a closed position. A locking element is attached to the first vertical stile that can be placed in a locked position that secures the shutter door closed, and an open position that allows the shutter door to be opened. However, as above, the locking element cannot be positioned in the open position when the plurality of louvers also is positioned in the open position. To add further security, at least one locking rod is attached to the locking element at one end and has a second end positioned within the inner frame assembly when the locking mechanism is positioned in the locked position. The locking rod is positioned outside the inner frame assembly when the locking mechanism is in the open position.

To prevent the locking element from being unlocked while the louvers are open, this embodiment includes a louver flange attached to the locking rod. The louver flange slides out and extends over the louvers when the louvers are in the closed position and the locking element is in the open position. As above, the louvers block the louver flange from being positioned over the louvers when the louvers are in the open position.

In a further embodiment, a security shutter assembly having a hingedly attached louver flange is disclosed. In this embodiment, the security shutter assembly includes a shutter door that includes first and second vertical stiles, wherein a plurality of operable louvers is pivotally mounted between the vertical stiles, the plurality of operable louvers capable of being rotated to an open position and a closed position. As above, a locking element is attached to the first vertical stile, and can be placed in a locked position that secures the shutter door closed, and an open position that allows the shutter door to be opened. In this embodiment, a louver flange is hingedly attached to the locking element, and extends over the louvers when the louvers are in the closed position and the locking element is in the open position. Thus, the locking element cannot be positioned in the open position when the plurality of louvers is positioned in the open position.

In this manner, embodiments of the present invention advantageously provide a means of securing openings in structures, while maintaining a pleasing appearance of normal shuttered windows or other openings. When the louvers are set in an open position, light and air is allowed to substantially pass through the security shutters in a manner similar to standard interior shutters. Embodiments of the present invention advantageously maintain security while the louvers are in an open position by preventing the locking elements from being set to an open and unlocked position while the louvers are in an open position. Since the louvers must be placed in a closed position for the locking elements to be unlocked, potential intruders are thwarted from opening the security shutters by reaching through the open louvers to unlock the locking elements. Moreover, embodiments of the present invention allow easy egress by allowing the locking mechanism to be easily rotated to an open position when the louvers are in the closed position.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for providing a security shutter assembly having an appearance of a standard shutter, such as a traditional shutter, California shutter, plantation shutter, or other shutter having operable louvers. Broadly speaking, embodiments of the present invention provide security by forming the shutter assembly from a hard metal, such as steel. The shutter assembly is then coated with paint or other substance to resemble a standard shutter. Moreover, the embodiments of the present invention include a locking element that can be set to a locked or an open position. When the locking element is set to the locked position, the louvers of the shutter can be moved to any desired setting. However, in order to set the locking element to the open position, and thus allow the shutter door to be opened, the louvers must be positioned in a closed position. In this manner, embodiments of the present invention cannot be opened from the outside.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention. Moreover, in the exemplary illustrations of FIGS. 2A-6B below, the shutter doors of the security shutter assembly are shown having four louvers. However, it should be borne in mind that any number of operable louvers may included in the embodiments of the present invention, such the nine louvers illustrated in FIG. 1. In addition, in FIGS. 2A-6B below, the shutter doors are shown slightly separated in order to better illustrate the locking element of the embodiments of the present invention. However, it should be noted that the shutter doors of the embodiments of the present invention generally are disposed directly next to each other when in the closed position, as illustrated next with reference to FIG. 1.

Figure 1:
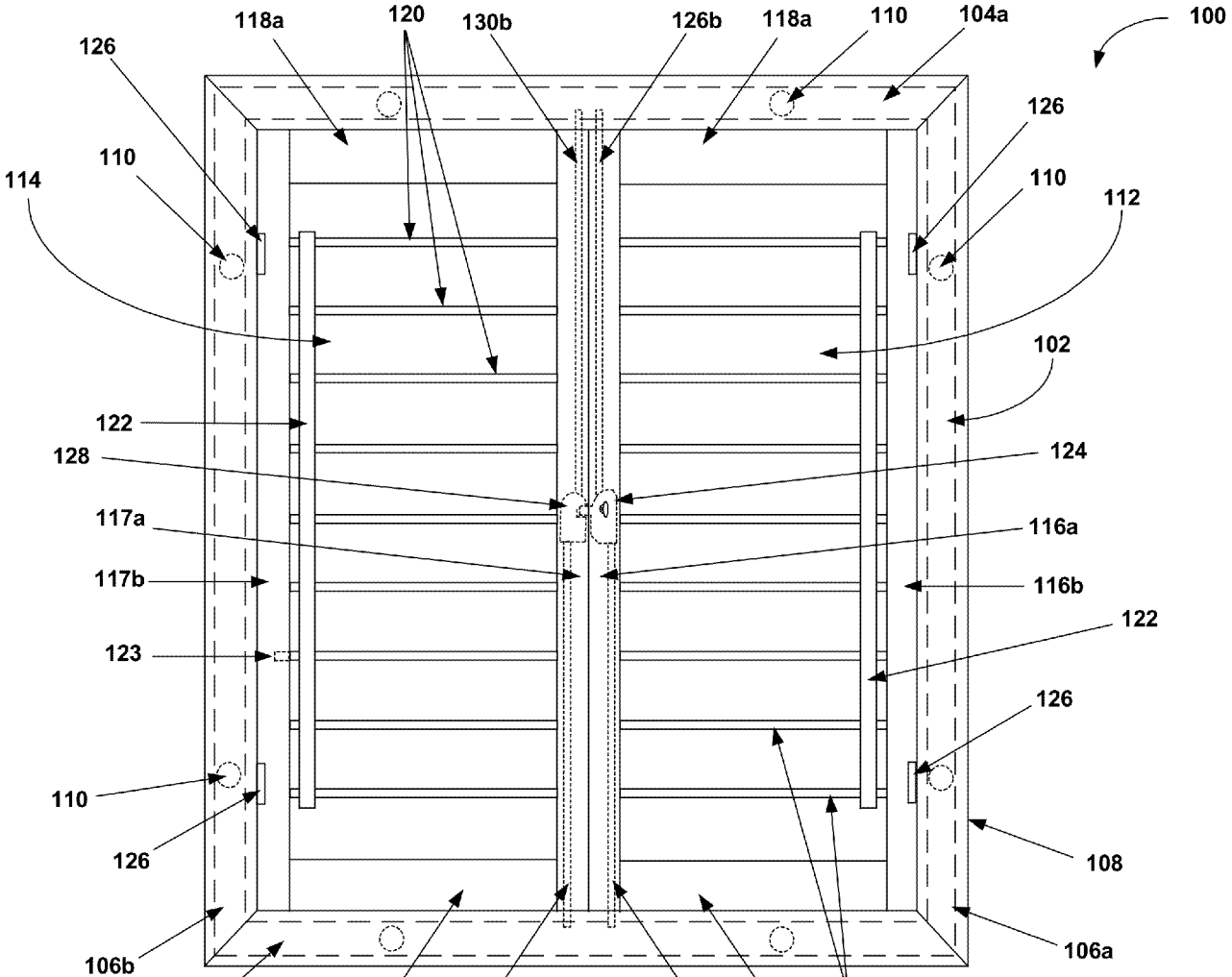
FIG. 1 is a diagram showing a security shutter assembly mounted over an opening viewed from inside a structure, in accordance with an embodiment of the present invention.

FIG. 1 is a diagram showing a security shutter assembly 100 mounted over an opening and viewed from inside a structure, in accordance with an embodiment of the present invention. The security shutter assembly 100 includes an inner frame assembly 102, preferably formed of a steel or other hard metal, that includes an upper horizontal frame member 104*a* and a lower horizontal frame member 104*b*, as wells as vertical frame members 106*a* and 106*b*. Lag bolts 110 can be utilized to secure the inner frame assembly 102 about an opening to be shuttered, for example, by securing the inner frame assembly 102 to wall studs located in the vicinity of the opening. Covering the inner frame assembly 102 is a decorative fascia casing 108, generally utilized to provide a pleasing look to the security shutter assembly 100.

The security shutter assembly 100 of FIG. 1 further includes shutter doors 112 and 114. Although FIG. 1 illustrates a security shutter assembly having two shutter doors, it should be noted that any number of shutter doors can be utilized using the teachings of the embodiments of the present invention, including one shutter door, four shutter doors or any other number of shutter doors as needed by a particular design application. Each shutter door 112 and 114 comprises a plurality of vertical stiles 116*a*/116*b* and 117*a*/117*b* connected to one or more horizontal rails 118*a* and 118*b*. Each shutter door 112 and 114 further includes a plurality of operable louvers 120, each connected to a tilt rod 122 which is utilized to adjust the position of the louvers 120 and to keep the louvers 120 in a uniform position. In addition, each louver 120 includes a metal pivoting rod 123, which provides added strength to the louver as well as providing a mechanism on which the louver 120 can rotate. Each shutter door 112 and 114 is hingedly attached to the inner frame assembly 102 via a plurality of security hinges 126. Preferably, vertical stiles 116*a*/116*b* and 117*a*/117*b*, horizontal rails 118*a* and 118*b*, louvers 120, and tilt rods 122 of the shutter doors 112 and 114 are formed of a metal, such as aluminum or steel, or other hard substance to provide security when the shutters are in a closed and locked position.

To secure the shutter doors 112 and 114 in a closed position, the security shutter assembly 100 further includes a primary locking element 124 hingedly attached to vertical stile 116*a*. Although FIG. 1 illustrates the locking element 124 disposed within the vertical stile 116*a*, it should be noted that the locking element can be located outside the vertical stile 116*a* as dictated by design preferences. The primary locking element 124 further is attached to locking rods 126*a* and 126*b*. The primary locking element 124 engages the locking rods 126*a* and 126*b* into the inner frame assembly 102 when set in a locked position, as illustrated in FIG. 1, thus preventing the shutter door 112 from being opened. When set to an open position, the primary locking element 124 disengages the locking rods 126*a* and 126*b* from the inner frame assembly 102 allowing the shutter door 112 to be opened.

Similarly, the security shutter assembly 100 includes a secondary locking element 128 hingedly attached to vertical stile 117*a* in FIG. 1. Although FIG. 1 illustrates the secondary locking element 128 disposed within the vertical stile 117*a*, it should be noted that the locking element can be located outside the vertical stile 117*a* as dictated by design preferences. Similar to above, the secondary locking element 128 is attached to locking rods 130*a* and 130*b*, and engages the locking rods 130*a*/130*b* into the inner frame assembly 102 when set in a locked position, as illustrated in FIG. 1, thus preventing the shutter door 114 from being opened. When set to an open position, the secondary locking element 128 disengages the locking rods 130*a* and 130*b* from the inner frame assembly 102 allowing the shutter door 114 to be opened.

As will be described in greater detail subsequently, neither the primary locking element 124 nor the secondary locking element 128 can be set to the open position while the louvers 120 of the shutter doors 112 or 114 are in an open position, wherein the open position is defined as the louvers 120 being set so as to allow light and air to freely pass through the aperture. As such, a potential intruder located outside the structure having the shuttered opening cannot reach through the open louvers 120 to open either locking element 124 or 128 because the locking elements 124 and 128 can only be set to the open position when the louvers 120 are in a closed position, defined as substantially blocking light through the shutter door. Of course, when the louvers 120 are in the closed position, a potential intruder cannot reach through the louvers 120 to operate either locking element 124 or 128.

In one embodiment all louvers 120 of the security shutter assembly 100 are required to be in the closed position in order to set either the primary locking element 124 or the secondary locking element 128 to the open position. In this manner, the locking elements 124 and 128, and thus the shutter doors 112 and 114, cannot be opened from outside.

Hence, embodiments of the present invention advantageously can provide aperture security when the louvers 120 are set to an open position because the locking elements 124 and 128 cannot be set to an opened position while the louvers 120 are set to the open position. Moreover, embodiments of the present invention provide easy egress to individuals located within the shuttered structure by allowing the locking mechanisms to be set to an open position upon closing of the louvers 120. Specifically, to open a shutter door 112 or 114, the louvers 120 are set to the closed position, typically utilizing the tilt rods 122, and then the locking elements 124 and 128 are rotated to an open position to disengage the locking rods 126*a*/126*b* and 130*a*/130*b* from the inner frame assembly 102.

Figure 2A:
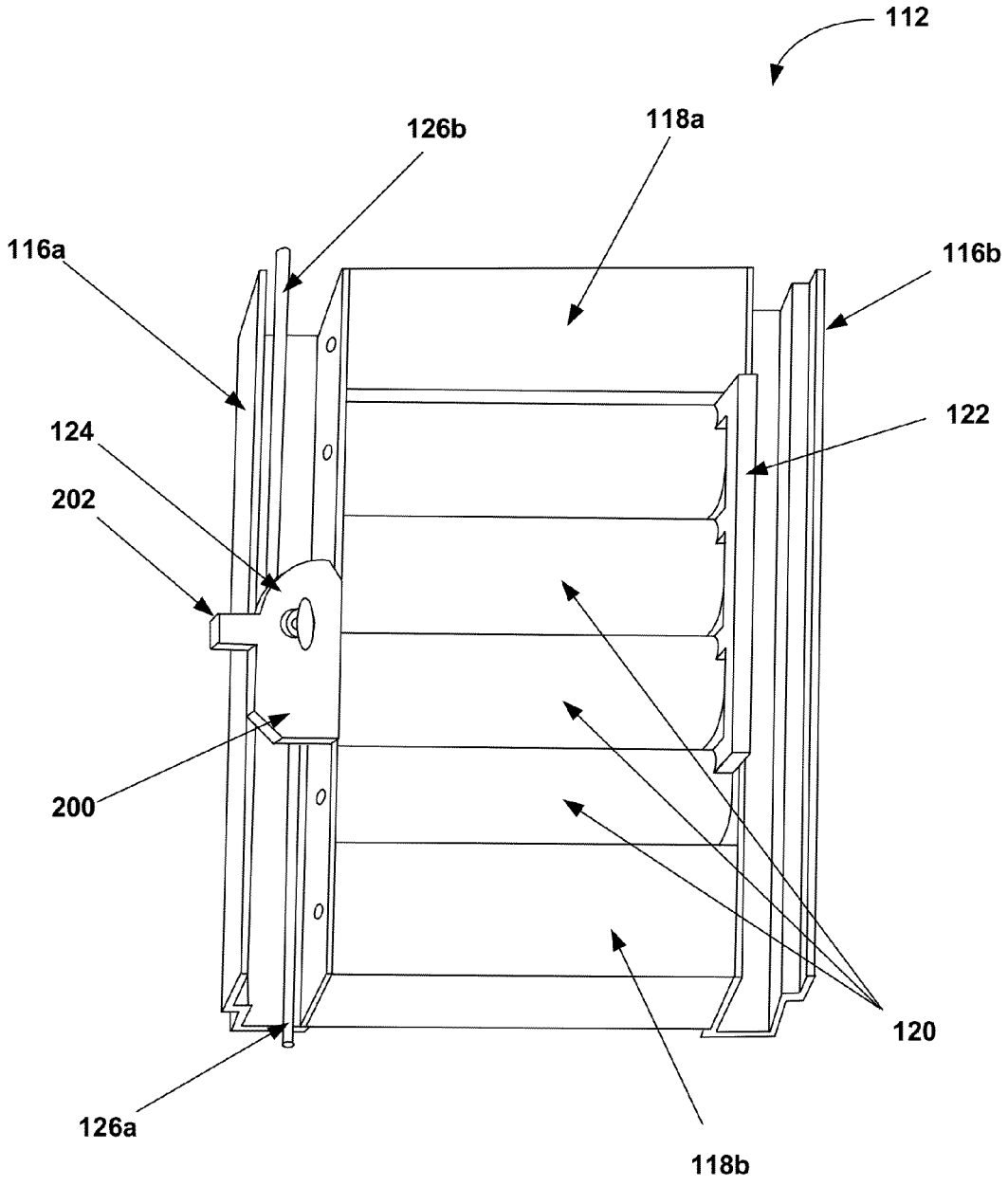
FIG. 2A is an illustration showing a shutter door having primary locking element in a locked position, in accordance with an embodiment of the present invention.

FIG. 2A is an illustration showing a shutter door 112 having primary locking element 124 in a locked position, in accordance with an embodiment of the present invention. For illustration purposes, the vertical stiles 116*a* and 116*b* are shown cut away so as to better illustrate the locking element 124 operation. The shutter door 112 comprises a plurality of vertical stiles 116*a*/116*b* connected to horizontal rails 118*a*/118*b*.

The shutter door 112 further includes a plurality of operable louvers 120, each connected to a tilt rod 122 which is utilized to adjust the position of the louvers 120 and to keep the louvers 120 in a uniform position. Preferably, vertical stiles 116*a* and 116*b*, louvers 120, and the tilt rod 122 are formed of a metal, such as aluminum or steel, or other hard substance to provide security when the shutters are in a closed and locked position.

The shutter door 112 further includes a primary locking element 124 hingedly attached to vertical stile 116*a*. Although FIG. 2A illustrates the locking element 124 disposed within the vertical stile 116*a*, it should be noted that the locking element can be located outside the vertical stile 116*a* as dictated by design preferences. The primary locking element 124 further is attached to locking rods 126*a* and 126*b*, and engages the locking rods 126*a* and 126*b* into the inner frame assembly when set in a locked position. When set to an open position, the primary locking element 124 disengages the locking rods 126*a* and 126*b* from the inner frame assembly 102 allowing the shutter door 112 to be opened.

In the embodiment of FIG. 2A, the primary locking element 124 includes a louver flange portion 200 and a locking flange portion 202. The locking flange portion 202 of the primary locking element 124 engages into a locking receptacle, generally located within the inner frame assembly, when the locking element is in a locked position to secure the shutter door 112 closed. The louver flange portion 200 of the primary locking element 124 swings over the louvers 120 when the locking element is positioned in an open position, as illustrated next in FIG. 2B.

Figure 2B:
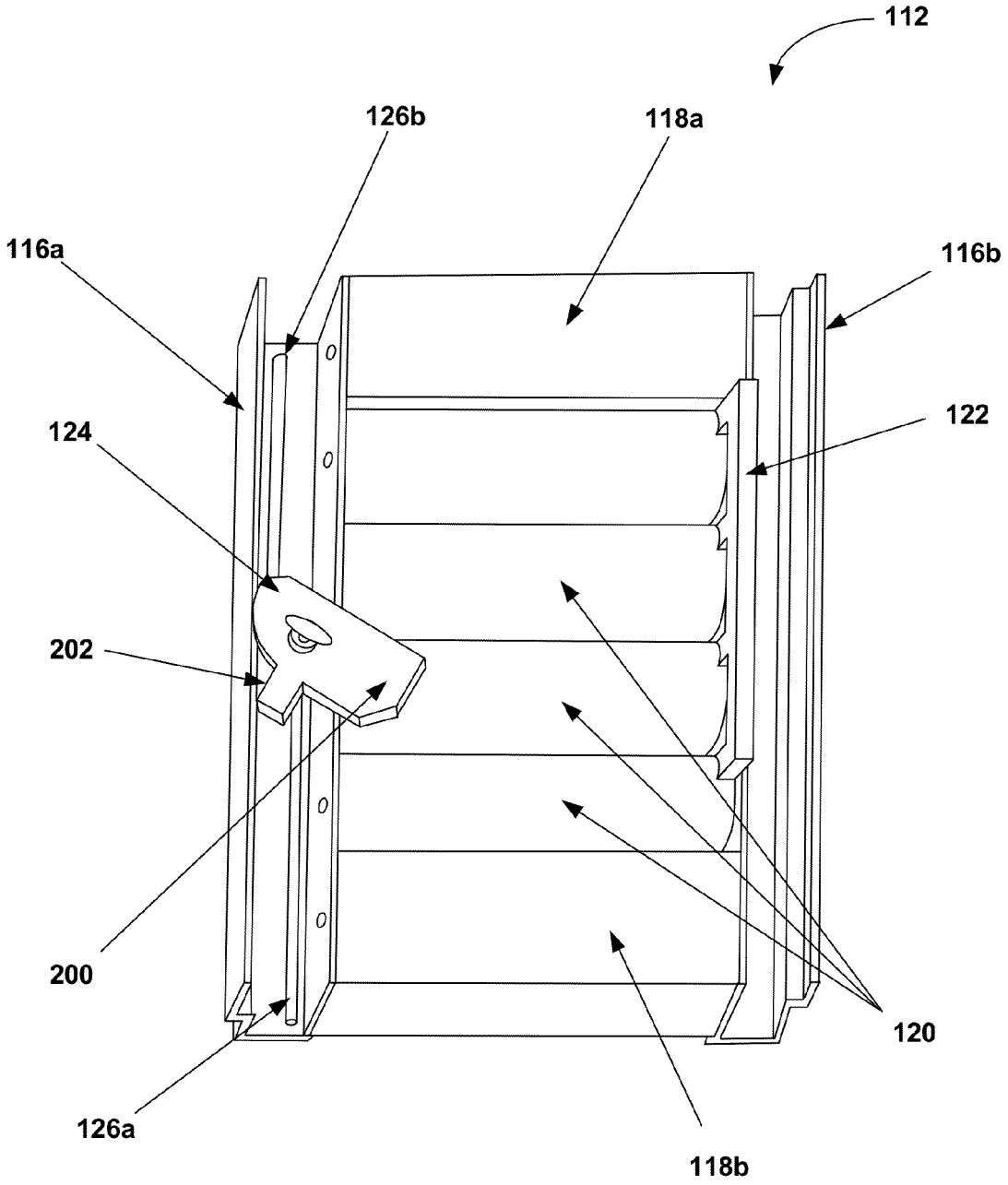
FIG. 2B is an illustration showing the shutter door having primary locking element in an opened position, in accordance with an embodiment of the present invention.

FIG. 2B is an illustration showing the shutter door 112 having primary locking element 124 in an opened position, in accordance with an embodiment of the present invention. As above, for illustration purposes, the vertical stiles 116*a* and 116*b* are shown cut away so as to better illustrate the locking element 124 operation. As illustrated in FIG. 2B, the louver flange portion 200 of the primary locking element 124 must swing over the louvers 120 in order for the primary locking element 124 to be positioned in an open position. As such, the louvers 120 block the louver flange portion 200 of the primary locking element 124 from moving over the louvers 120 when the louvers 120 are positioned in an open position. Hence, in order for the louver flange portion 200 of the primary locking element 124 to move over the louvers 120, the louvers 120 must be positioned in a closed position. Thus, the louvers 120 must be positioned in a closed position in order for the primary locking element 124 to be positioned in the open, and unlocked, position.

Figure 3A:
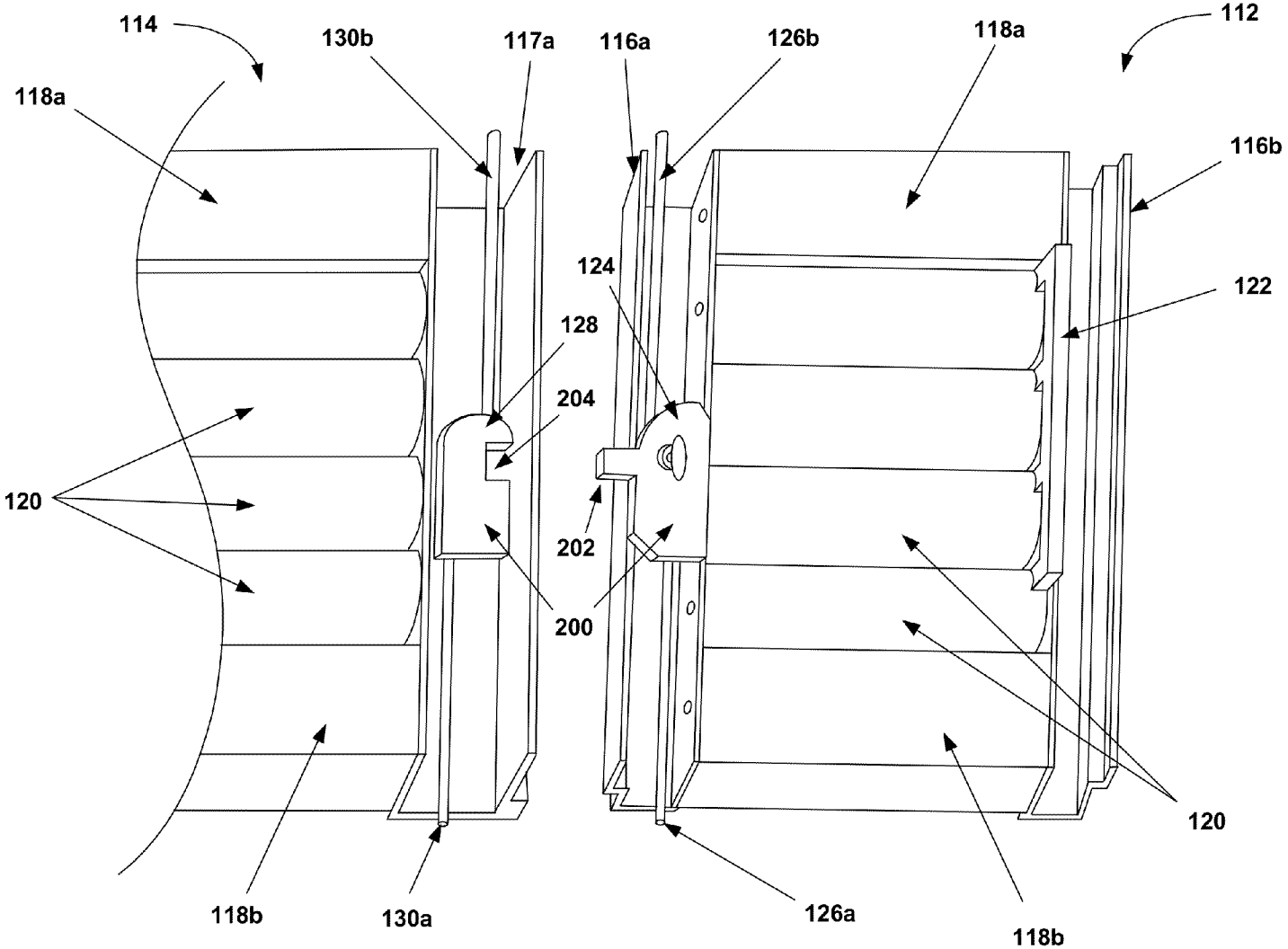
FIG. 3A is an illustration showing a dual shutter doors having the primary locking element and secondary locking element in locked positions, in accordance with an embodiment of the present invention.

FIG. 3A is an illustration showing dual shutter doors 112 and 114 having the primary locking element 124 and secondary locking element 128 in locked positions, in accordance with an embodiment of the present invention. For illustration purposes, the vertical stiles 116*a*/116*b* and 117*a*/117*b* are shown cut away so as to better illustrate the locking elements operation. Each shutter door 112 and 114 comprises a plurality of vertical stiles 116*a*/116*b* and 117*a*/117*b* connected to horizontal rails 118*a*/118*b*. The shutter doors 112 and 114 further include a plurality of operable louvers 120, each connected to a tilt rod 122, utilized to adjust the position of the louvers 120 and to keep the louvers 120 in a uniform position.

Shutter door 112 includes a primary locking element 124 hingedly attached to vertical stile 116*a*. Shutter door 114 includes a secondary locking element 128 hingedly attached to vertical stile 117*a*. The primary locking element 124 further is attached to locking rods 126*a* and 126*b*, and engages the locking rods 126*a* and 126*b* into the inner frame assembly 102 when set in a locked position. Similarly, the secondary locking element 128 is attached to locking rods 130*a* and 130*b*, and engages the locking rods 130*a* and 130*b* into the inner frame assembly when set in a locked position.

In the embodiment of FIG. 3A, the primary locking element 124 includes a louver flange portion 200 and a locking flange portion 202, while the secondary locking element 128 includes a louver flange portion 200 and a locking receptacle 204. The locking flange portion 202 of the primary locking element 124 engages into a locking receptacle 204 of the secondary locking element when the locking elements 124 and 128 are in a locked position to secure the shutter doors 112 and 114 closed. The louver flange portions 200 of both the primary locking element 124 and the secondary locking element 128 swing over the louvers 120 when the locking elements 124 and 128 are positioned in an open position, as illustrated next in FIG. 3B.

Figure 3B:
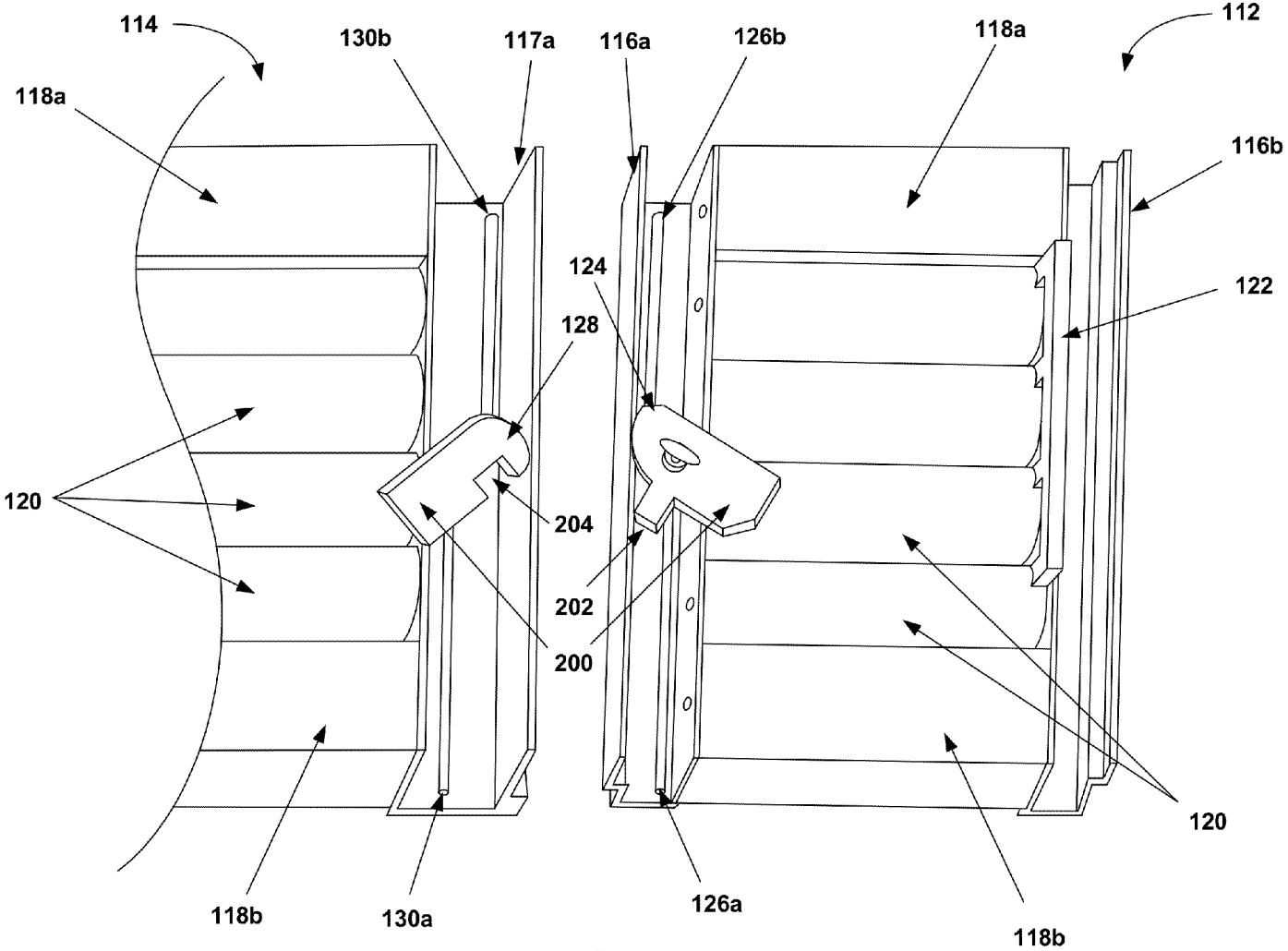
FIG. 3B is an illustration showing the dual shutter doors having the locking elements in an opened position, in accordance with an embodiment of the present invention.

FIG. 3B is an illustration showing the dual shutter doors 112 and 114 having the locking elements 124 and 128 in an opened position, in accordance with an embodiment of the present invention. As above, for illustration purposes, the vertical stiles 116*a*/116*b* and 117*a*/117*b* are shown cut away so as to better illustrate the locking element operation. As illustrated in FIG. 3B, the louver flange portions 200 of both the primary locking element 124 and secondary locking element 128 must swing over the louvers 120 in order for the primary locking element 124 and secondary locking element 128 to be positioned in an open position. As such, the louvers 120 block the louver flange portions 200 of the locking elements 124 and 128 from moving over the louvers 120 when the louvers 120 are positioned in an open position.

In order for the louver flange portions 200 of the locking elements 124 and 128 to move over the louvers 120, the louvers 120 must be positioned in a closed position. Thus, the louvers 120 must be positioned in a closed position in order for the locking elements 124 and 128 to be positioned in the open, and unlocked, position. Moreover, in one embodiment, both the primary locking element 124 and the secondary locking element 128 are required to rotate open together in order for either locking element 124 and 128 to be opened, thus preventing a potential intruder from reaching through the louvers 120 of one shutter door to open the other shutter door. In addition to forming the louver flange portion 200 integrated into the locking elements 124 and 128, the louver flange portion 200 can be located separately from the locking elements 124 and 128, as illustrated next with reference to FIG. 4A.

Figure 4A:
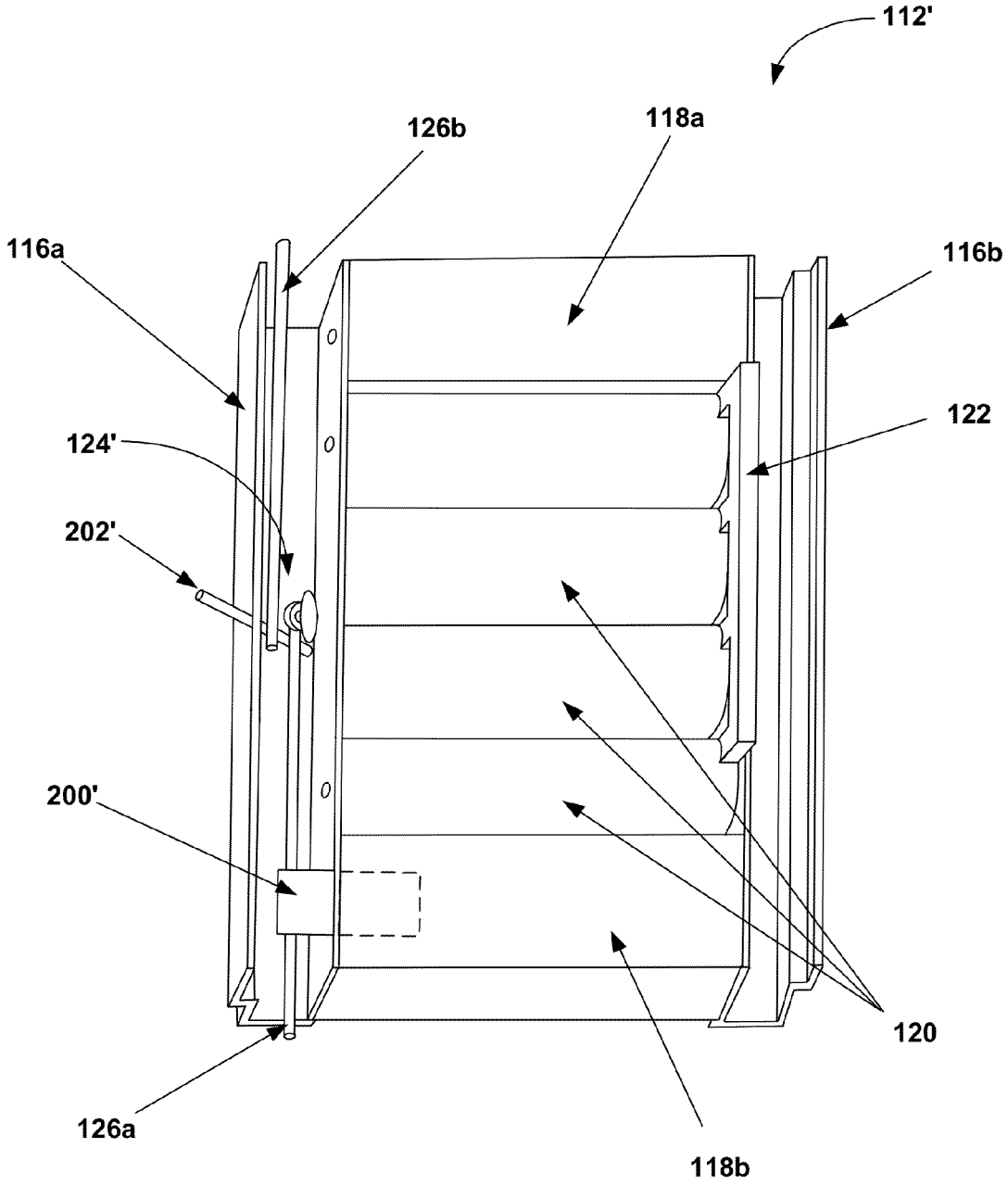
FIG. 4A is an illustration showing a shutter door including a primary locking element having a separate louver flange portion, wherein primary locking element is in a locked position, in accordance with an embodiment of the present invention.

FIG. 4A is an illustration showing a shutter door 112' including a primary locking element 124' having a separate louver flange portion 200', wherein primary locking element 124' is in a locked position, in accordance with an embodiment of the present invention. As above, the vertical stiles 116*a* and 116*b* are shown cut away so as to better illustrate the locking element 124' operation. The shutter door 112' comprises a plurality of vertical stiles 116*a*/116*b* connected to horizontal rails 118*a*/118*b*. The shutter door 112' further includes a plurality of operable louvers 120, each connected to a tilt rod 122 which is utilized to adjust the position of the louvers 120 and to keep the louvers 120 in a uniform position.

Similar to the embodiment of FIG. 3A, the primary locking element 124' of FIG. 4A is attached to locking rods 126*a* and 126*b*, and engages the locking rods 126*a* and 126*b* into the inner frame assembly when set in a locked position. When set to an open position, the primary locking element 124' disengages the locking rods 126*a* and 126*b* from the inner frame assembly allowing the shutter door 112' to be opened. In the embodiment of FIG. 4A, the louver flange portion 200' is located separately from the locking element 124', and is attached to locking rod 126*a*. Although the louver flange portion 200' is shown attached to locking rod 126*a*, it should be noted that the louver flange portion 200' can be attached to locking rod 126*b*, and thus can be attached to either locking rod 126*a* or 126*b*.

The locking flange portion 202' of the primary locking element 124' engages into a locking receptacle when the locking element is in a locked position to secure the shutter door 112' closed. The louver flange portion 200' is located within the horizontal rail 118*b* when the primary locking element 124' is in the locked position, as illustrated in FIG. 4A. However, when the primary locking element 124' is placed in the open position, the louver flange portion 200' moves over the louvers 120, as illustrated next in FIG. 4B.

Figure 4B:
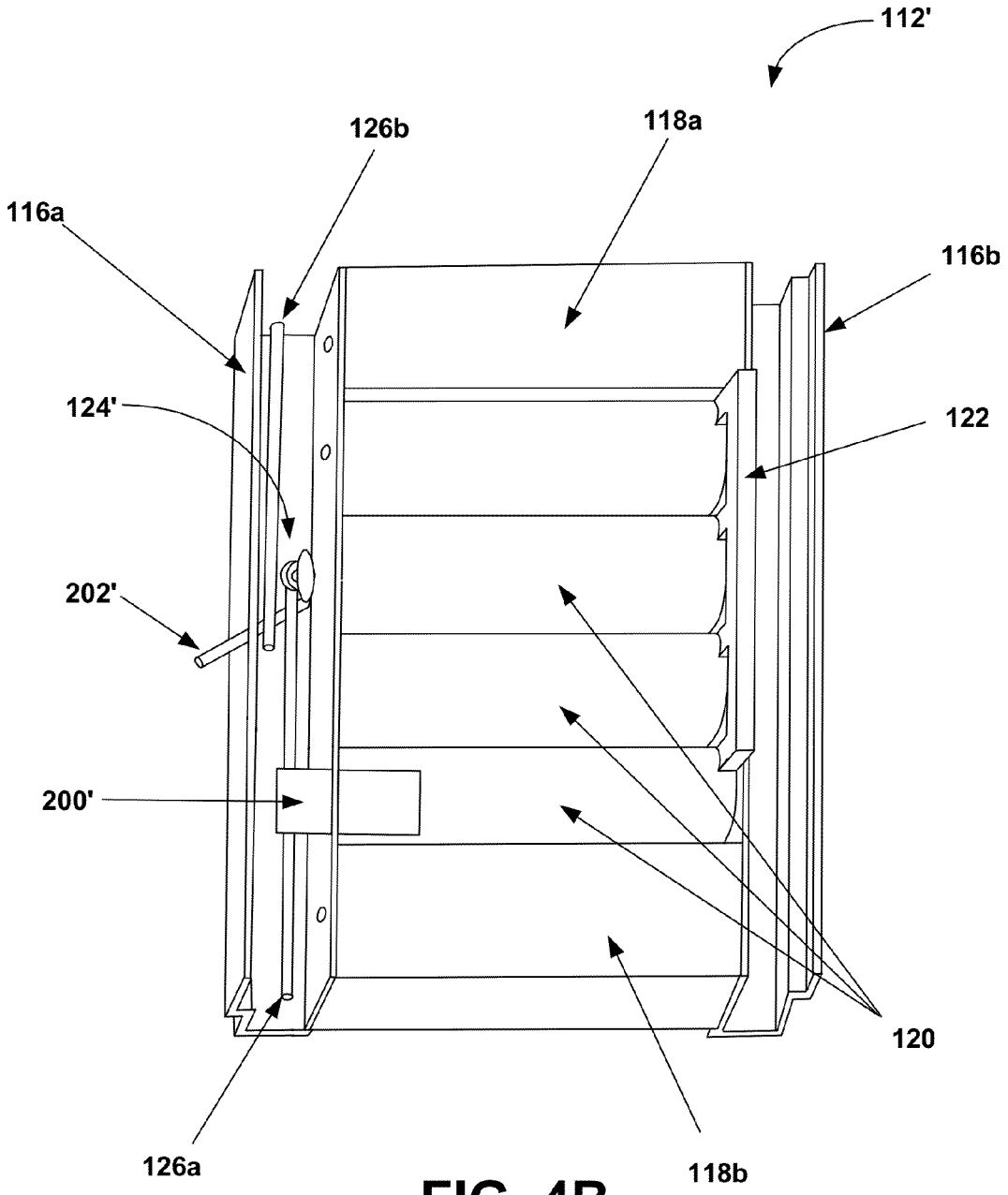
FIG. 4B is an illustration showing the shutter door having primary locking element in an opened position, in accordance with an embodiment of the present invention.

FIG. 4B is an illustration showing the shutter door 112' having primary locking element 124' in an opened position, in accordance with an embodiment of the present invention. As above, for illustration purposes, the vertical stiles 116*a* and 116*b* are shown cut away so as to better illustrate the locking element 124' operation. As illustrated in FIG. 4B, the louver flange portion 200' must slide toward the louvers 120 and move over the louvers 120 in order for the primary locking element 124' to be positioned in an open position. As such, the louvers 120 block the louver flange portion 200' from moving over the louvers 120 when the louvers 120 are positioned in an open position.

Hence, in order for the louver flange portion 200' to move over the louvers 120, the louvers 120 must be positioned in a closed position. As a result, the louvers 120 must be positioned in a closed position in order for the primary locking element 124' to be positioned in the open, and unlocked, position. As with previously described embodiments, the embodiment of FIG. 4A and FIG. 4B can be utilized in dual shutter configuration, as described next with reference to FIG. 5A.

Figure 5A:
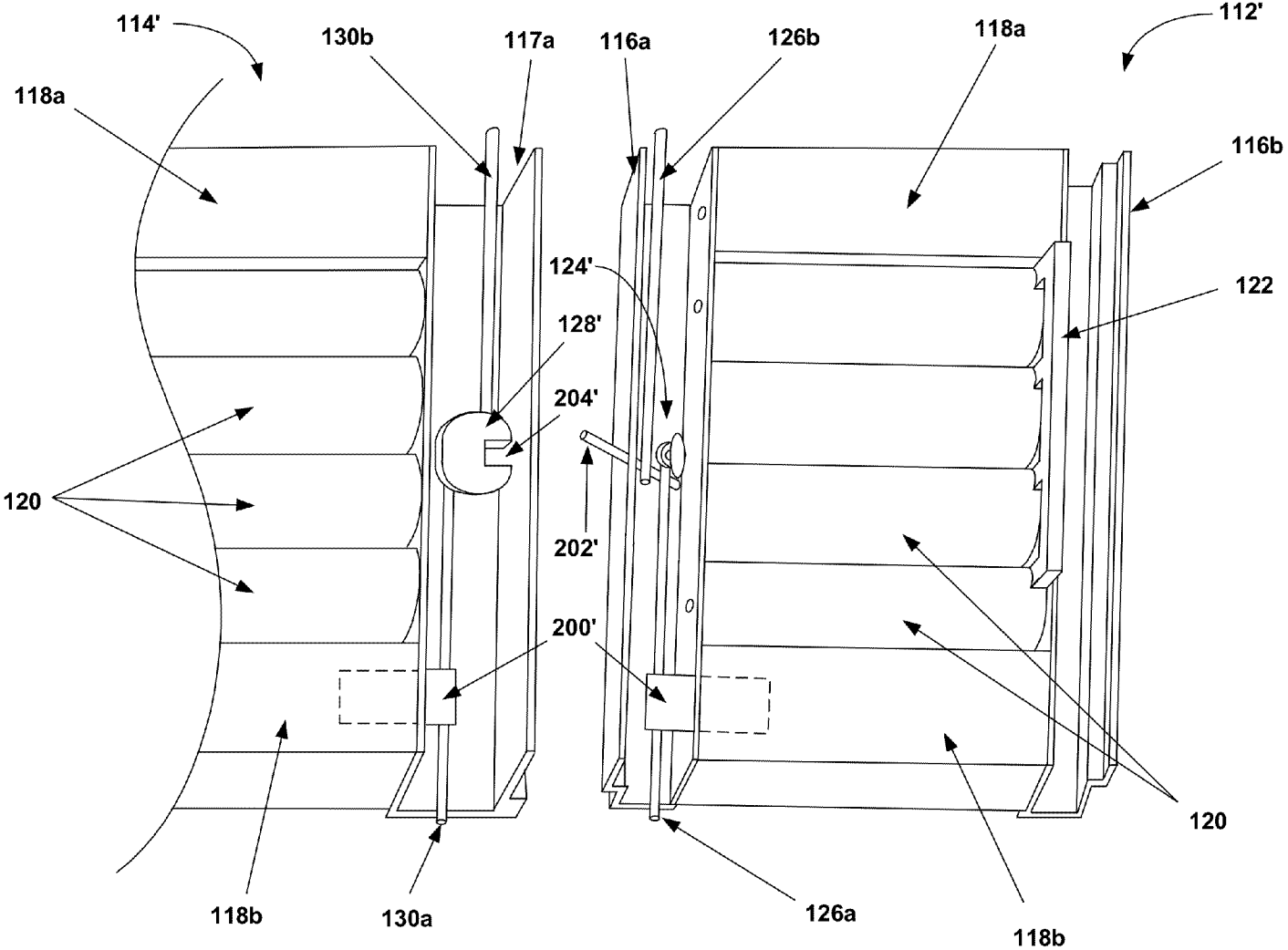
FIG. 5A is an illustration showing a dual shutter doors having the primary locking element and secondary locking element, and having separate louver flange portions, wherein each locking element is in a locked position, in accordance with an embodiment of the present invention.

FIG. 5A is an illustration showing a dual shutter doors 112' and 114' having the primary locking element 124' and secondary locking element 128', and having separate louver flange portions 200', wherein each locking element 124'/128' is in a locked position, in accordance with an embodiment of the present invention. The vertical stiles 116*a*/116*b* and 117*a*/117*b* are shown cut away so as to better illustrate the locking elements operation. Each shutter door 112' and 114' comprises a plurality of vertical stiles 116*a*/116*b* and 117*a*/117*b* connected to horizontal rails 118*a*/118*b*. The shutter doors 112' and 114' further include a plurality of operable louvers 120, each connected to a tilt rod 122, utilized to adjust the position of the louvers 120 and to keep the louvers 120 in a uniform position.

Shutter door 112' includes a primary locking element 124', and shutter door 114' includes a secondary locking element 128'. The primary locking element 124' further is attached to locking rods 126*a* and 126*b*, and engages the locking rods 126*a* and 126*b* into the inner frame assembly when set in a locked position. Similarly, the secondary locking element 128' is attached to locking rods 130*a* and 130*b*, and engages the locking rods 130*a* and 130*b* into the inner frame assembly when set in a locked position.

In the embodiment of FIG. 5A, the primary locking element 124' includes a locking flange portion 202', while the secondary locking element 128' includes a locking receptacle 204'. The locking flange portion 202' of the primary locking element 124' engages into a locking receptacle 204' of the secondary locking element 128' when the locking elements 124' and 128' are in a locked position to secure the shutter doors 112' and 114' closed. The louver flange portions 200' are attached to their respective locking rods 126*a*/130*a* as illustrated in FIG. 5A. When the primary locking element 124' and 128' are in the locked position, the louver flange portions 200' are located within the horizontal rail 118*b*. However, when the locking elements 124' and 128' are placed in the open position, the louver flange portions 200' moves over the louvers 120, as illustrated next in FIG. 5B.

Figure 5B:
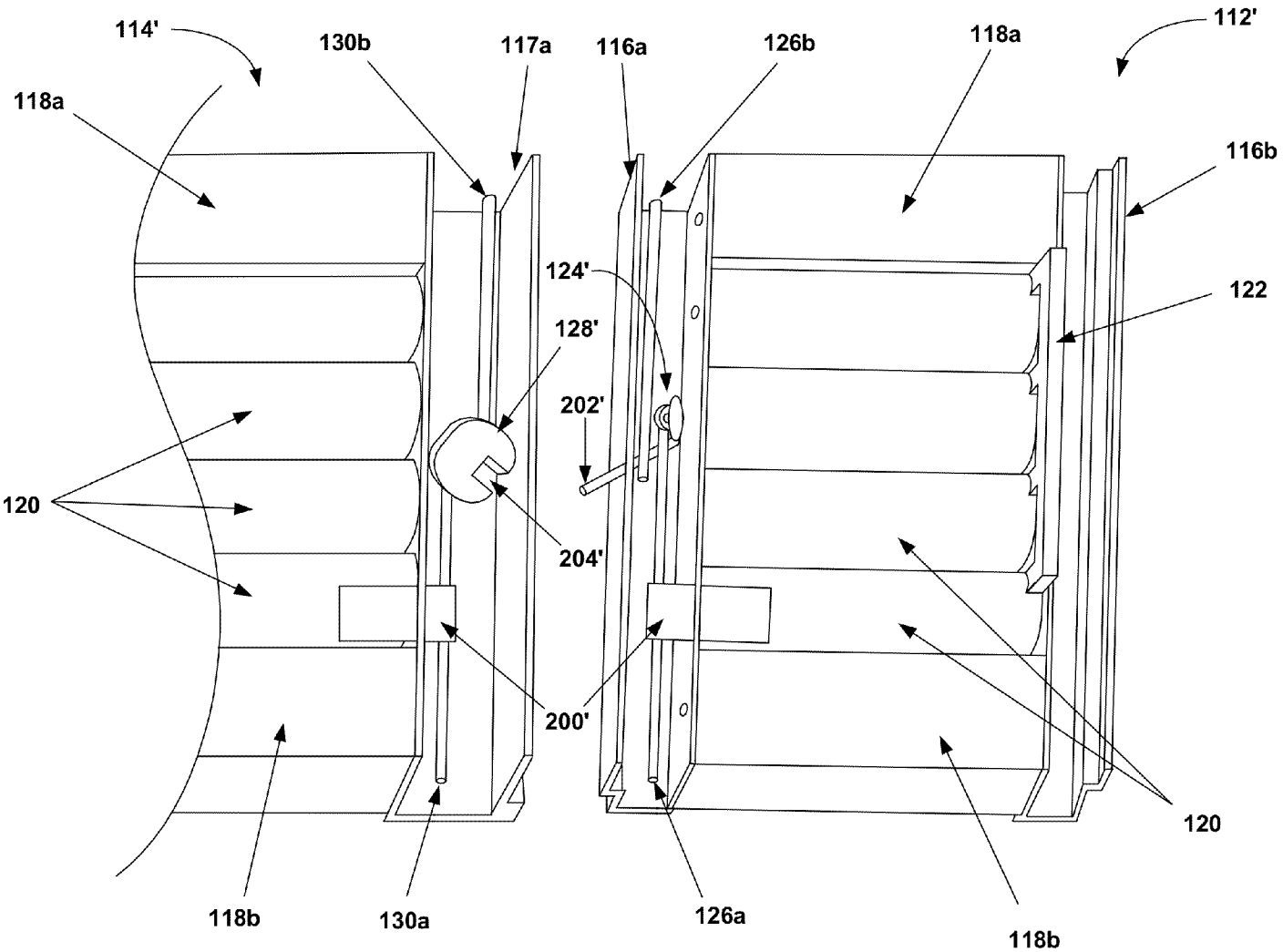
FIG. 5B is an illustration showing the dual shutter doors having the locking elements in an opened position, in accordance with an embodiment of the present invention.

FIG. 5B is an illustration showing the dual shutter doors 112' and 114' having the locking elements 124' and 128' in an opened position, in accordance with an embodiment of the present invention. As illustrated in FIG. 5B, the louver flange portions 200' of both the primary locking element 124' and secondary locking element 128' must side towards and move over the louvers 120 in order for the primary locking element 124' and secondary locking element 128' to be positioned in an open position. As such, the louvers 120 block the louver flange portions 200' from moving over the louvers 120 when the louvers 120 are positioned in an open position.

Hence, in order for the louver flange portions 200' of the locking elements 124' and 128' to move over the louvers 120, the louvers 120 must be positioned in a closed position. Since the louver flange portions 200' are attached to the same locking rods 126*a*/130*a* as their respective locking elements 124' and 128', the louvers 120 must be positioned in a closed position in order for the locking elements 124' and 128' to be positioned in the open, and unlocked, position. Moreover, in one embodiment, both the primary locking element 124' and the secondary locking element 128' are required to rotate open together in order for either locking element 124' and 128' to be opened, thus preventing a potential intruder from reaching through the louvers 120 of one shutter door to open the other shutter door. In addition to being integrated into a locking element or fixed to a locking rod, the louver flange of the embodiments of the present invention can be hingedly attached to the locking element, as illustrated subsequently, with reference to FIGS. 6A and 6B.

Figure 6A:
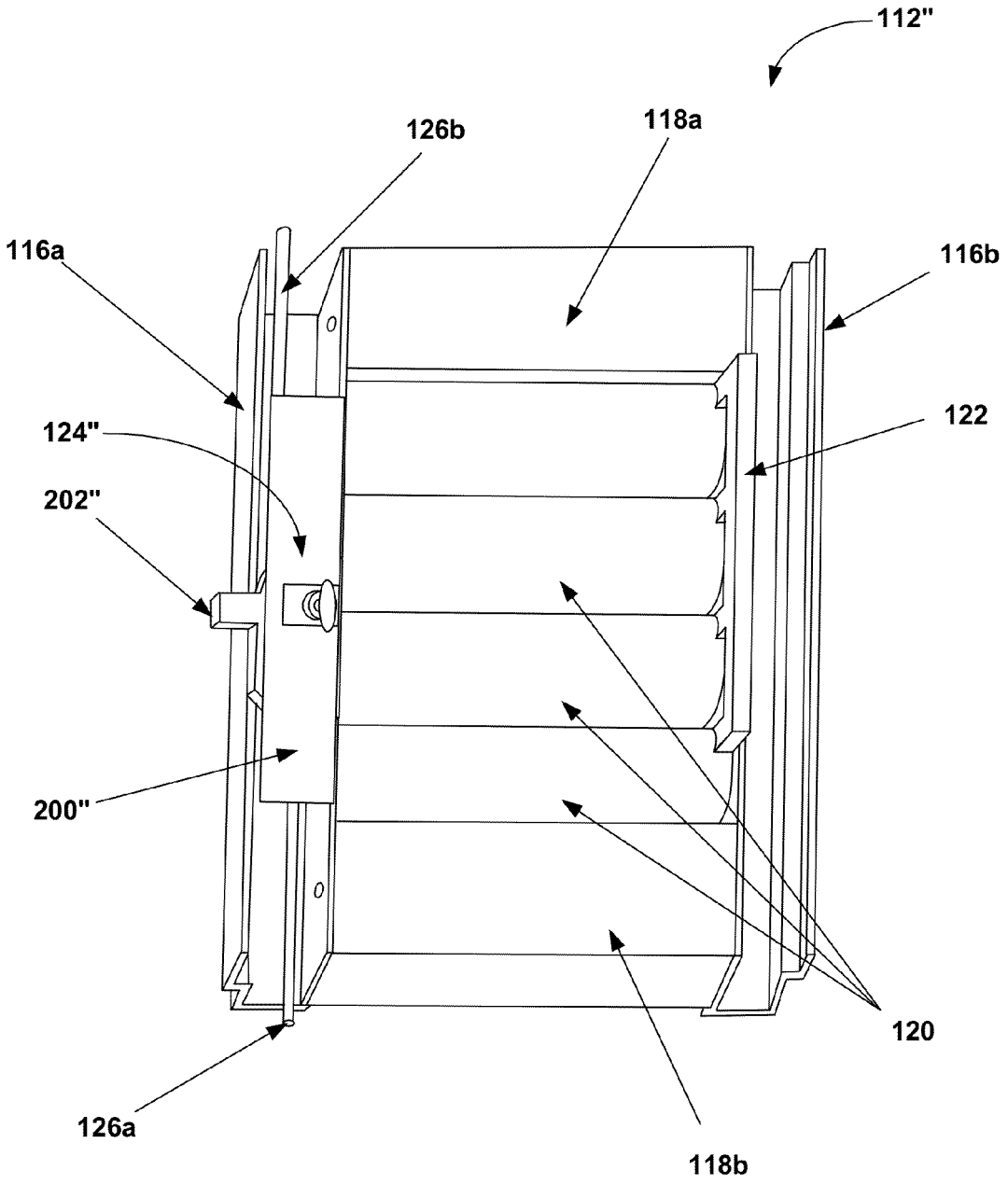
FIG. 6A is an illustration showing a shutter door having a louver flange portion hingedly attached to a primary locking element in a locked position, in accordance with an embodiment of the present invention.

FIG. 6A is an illustration showing a shutter door 112" having a louver flange portion 200" hingedly attached to a primary locking element 124" in a locked position, in accordance with an embodiment of the present invention. The vertical stiles 116*a* and 116*b* in FIG. 6A are shown cut away so as to better illustrate the locking element operation. The shutter door 112" comprises a plurality of vertical stiles 116*a*/116*b* connected to horizontal rails 118*a*/118*b*. The shutter door 112" further includes a plurality of operable louvers 120, each connected to a tilt rod 122 which is utilized to adjust the position of the louvers 120 and to keep the louvers 120 in a uniform position. Preferably, vertical stiles 116*a* and 116*b*, louvers 120, and the tilt rod 122 are formed of a metal, such as aluminum or steel, or other hard substance to provide security when the shutters are in a closed and locked position.

Further included in the shutter door 112" is a primary locking element 124" hingedly attached to vertical stile 116*a*. Although FIG. 6A illustrates the locking element 124" disposed within the vertical stile 116*a*, it should be noted that the locking element can be located outside the vertical stile 116*a* as dictated by design preferences. The primary locking element 124" further is attached to locking rods 126*a* and 126*b*, and engages the locking rods 126*a* and 126*b* into the inner frame assembly when set in a locked position. When set to an open position, the primary locking element 124" disengages the locking rods 126*a* and 126*b* from the inner frame assembly allowing the shutter door 112 to be opened.

In the embodiment of FIG. 6A, a louver flange portion 200" is hingedly attached to the primary locking element 124", which further includes and a locking flange portion 202". The locking flange portion 202" of the primary locking element 124" engages into a locking receptacle, generally located within the inner frame assembly, when the locking element 124" is in a locked position to secure the shutter door 112" closed. In one embodiment the louver flange portion 200" is hingedly attached to the primary locking element 124" offset from center. As such, the hingedly attached louver flange portion 200" slides over the louvers 120 when the primary locking element 124" is rotated to an open position, as illustrated next in FIG. 6B.

Figure 6B:
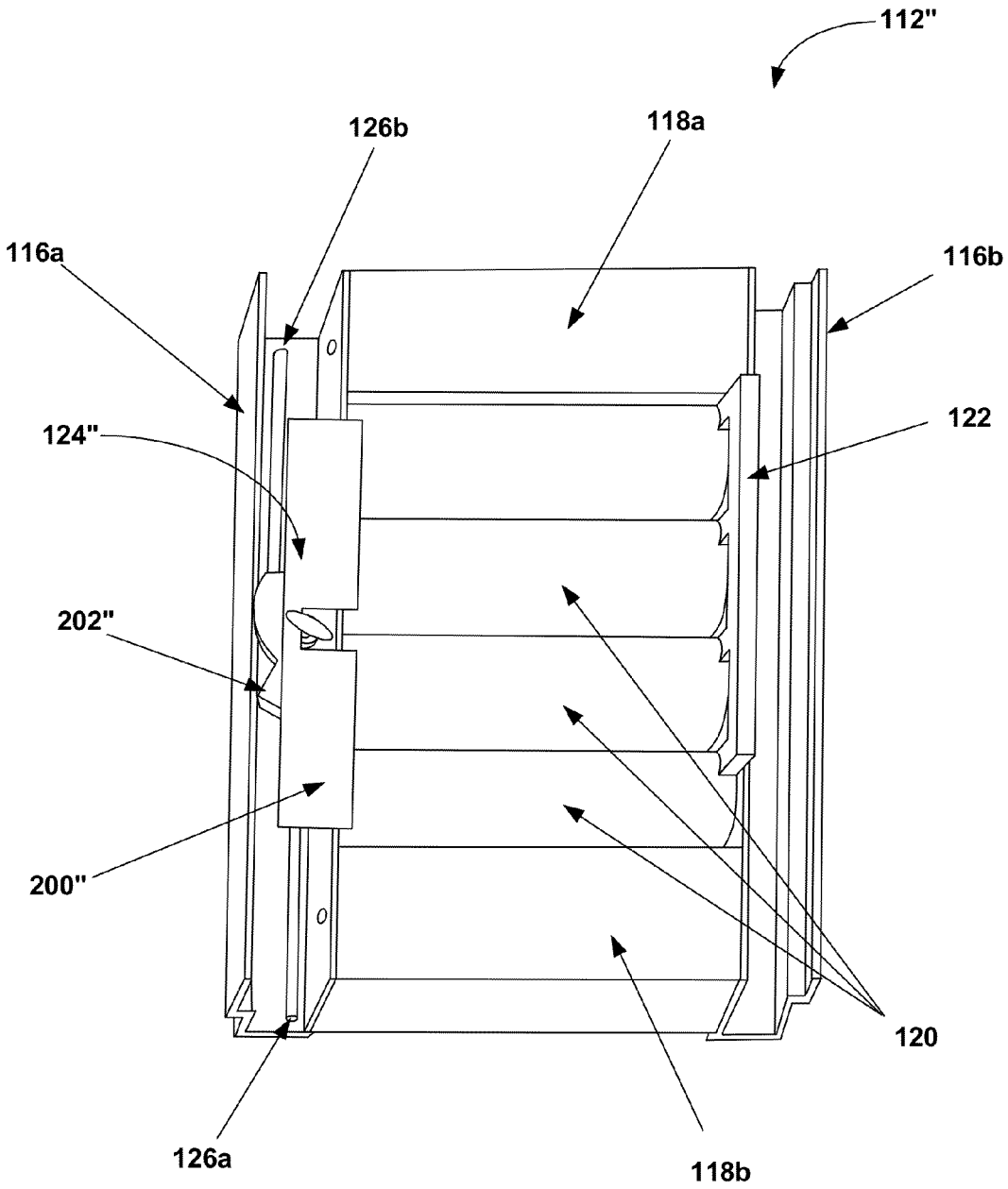
FIG. 6B is an illustration showing the shutter door having primary locking element in an opened position, in accordance with an embodiment of the present invention.

FIG. 6B is an illustration showing the shutter door 112" having primary locking element 124" in an opened position, in accordance with an embodiment of the present invention. As above, for illustration purposes, the vertical stiles 116*a* and 116*b* are shown cut away so as to better illustrate the locking element operation. As illustrated in FIG. 6B, the louver flange portion 200" must slide over the louvers 120 in order for the primary locking element 124" to be rotated to an open position. As such, the louvers 120 block the louver flange portion 200" from moving over the louvers 120 when the louvers 120 are positioned in an open position. Hence, in order for the louver flange portion 200" to slide over the louvers 120, the louvers 120 must be positioned in a closed position. Since the louver flange portion 200" is hingedly attached to the primary locking element 124", the louvers 120 must be positioned in a closed position in order for the primary locking element 124" to be positioned in the open, and unlocked, position.

Embodiments of the present invention advantageously provide a means of securing openings in structures, while maintaining a pleasing appearance of normal shuttered windows or other openings. When the louvers are set in an open position, light an air is allowed to substantially pass through the security shutters in a manner similar to standard interior shutters. Embodiments of the present invention advantageously maintain security while the louvers are in an open position by preventing the locking elements to be set to an open and unlocked position while the louvers are in an open position. Since the louvers must be placed in closed position for the locking elements to unlock, potential intruders are thwarted from opening the security shutters by reaching through the open louvers to unlock the locking elements. Moreover, embodiments of the present invention allow easy egress by allowing the locking mechanism to be easily rotated to an open position when the louvers are in a closed position.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A security shutter assembly, comprising:

a shutter door having a first and second vertical stiles, wherein a plurality of operable louvers is pivotally mounted between the first and second vertical stiles, the plurality of operable louvers capable of being rotated to an open position and a closed position; and a locking element attached to the first vertical stile, the locking element having a locked position that secures the shutter door closed, the locking element further having an open and unlocked position that allows the shutter door to be opened, wherein the locking element cannot be positioned in the open and unlocked position when the plurality of operable louvers is positioned in the open position and wherein the locking element includes a louver flange portion, wherein the louver flange portion is a flange that extends over the louvers when the louvers are in the closed position and the locking element is in the open and unlocked position; and wherein the louvers block the louver flange portion from being positioned over the louvers when the louvers are in the open position.

2. A security shutter assembly as recited in claim 1, further comprising an inner frame assembly, wherein the shutter door is disposed within the inner frame assembly.

3. A security shutter assembly as recited in claim 2, further comprising at least one locking rod, the locking rod having a first end attached to the locking element and a second end positioned within the inner frame assembly when the locking element is positioned in the locked position.

4. A security shutter assembly as recited in claim 3, wherein the locking rod is positioned outside the inner frame assembly when the locking element is in the open and unlocked position.

5. A security shutter assembly as recited in claim 2, further comprising decorative fascia casing disposed on the inner frame assembly.

6. A security shutter assembly as recited in claim 1, wherein the security shutter assembly is formed of a metal.

7. A security shutter assembly, comprising:

an inner frame assembly;

a shutter door disposed within the inner frame assembly, the shutter door having a first and second vertical stiles, wherein a plurality of operable louvers is pivotally mounted between the first and second vertical stiles, the plurality of operable louvers capable of being rotated to an open position and a closed position;

a locking element attached to the first vertical stile, the locking element having a locked position that secures the shutter door closed, the locking element further having an open and unlocked position that allows the shutter door to be opened, wherein the locking element cannot be positioned in the open and unlocked position when the plurality of louvers is positioned in the open position; and a locking rod having a first end and a second end, wherein the first end is attached to the locking element and the second end is positioned within the inner frame assembly when the locking element is positioned in the locked position and a louver flange attached to the locking rod, the louver flange extending over the louvers when the louvers are in the closed position and when the locking element is in the open and unlocked position; and wherein the louvers block the louver flange from being positioned over the louvers when the louvers are in the open position.

8. A security shutter assembly as recited in claim 7, wherein the locking rod is positioned outside the inner frame assembly when the locking mechanism is in the open and unlocked position.

9. A security shutter assembly as recited in claim 7, further comprising decorative fascia casing disposed on the inner frame assembly.

10. A security shutter assembly as recited in claim 7, wherein the security shutter assembly is formed of a metal.

11. A security shutter assembly, comprising:

a shutter door having a first and second vertical stiles, wherein a plurality of operable louvers is pivotally mounted between the first and second vertical stiles, the plurality of operable louvers capable of being rotated to an open position and a closed position;

a locking element attached to the first vertical stile, the locking element having a locked position that secures the shutter door closed, the locking element further having an open and unlocked position that allows the shutter door to be opened; and a louver flange hingedly attached to the locking element, the louver flange extending over the louvers when the louvers are in the closed position and the locking element is in the open and unlocked position, wherein the locking element cannot be positioned in the open and unlocked position when the plurality of louvers is positioned in the open position and wherein the louvers block the louver flange from being positioned over the louvers when the louvers are in the open position.

12. A security shutter assembly as recited in claim 11, further comprising an inner frame assembly, wherein the shutter door is disposed within the inner frame assembly.

13. A security shutter assembly as recited in claim 12, further comprising at least one locking rod having a first end and a second end, wherein the first end is attached to the locking element and the second end is positioned within the inner frame assembly when the locking mechanism is positioned in the locked position.

14. A security shutter assembly as recited in claim 13, wherein the locking rod is positioned outside the inner frame assembly when the locking mechanism is in the open and unlocked position.

15. A security shutter assembly as recited in claim 11, further comprising decorative fascia casing disposed on the inner frame assembly.

* * * * *